US007650676B2

(12) United States Patent
Saitsu

(10) Patent No.: US 7,650,676 B2
(45) Date of Patent: Jan. 26, 2010

(54) BUCKLE

(75) Inventor: Natsuko Saitsu, Kurobe (JP)

(73) Assignee: YKK Corporation, Tokyo (JP)

( * ) Notice: Subject to any disclaimer, the term of this patent is extended or adjusted under 35 U.S.C. 154(b) by 408 days.

(21) Appl. No.: 11/710,780

(22) Filed: Feb. 26, 2007

(65) Prior Publication Data

US 2007/0204441 A1 Sep. 6, 2007

(30) Foreign Application Priority Data

Mar. 2, 2006 (JP) ..... 2006-056607

(51) Int. Cl.
*A44B 11/25* (2006.01)

(52) U.S. Cl. ..... 24/615; 24/614; 24/625

(58) Field of Classification Search ..... 24/614, 24/615, 625

See application file for complete search history.

(56) References Cited

U.S. PATENT DOCUMENTS

| | | | | |
|---|---|---|---|---|
| 5,465,472 | A * | 11/1995 | Matoba | 24/625 |
| 5,791,026 | A | 8/1998 | Anscher | |
| 6,148,486 | A * | 11/2000 | Uehara et al. | 24/170 |
| 6,571,433 | B2 * | 6/2003 | Uehara et al. | 24/614 |
| 7,096,545 | B2 | 8/2006 | Uehara et al. | |
| 7,100,252 | B2 * | 9/2006 | Anscher | 24/615 |
| 7,320,160 | B2 * | 1/2008 | Uehara et al. | 24/615 |
| 2002/0040514 | A1 | 4/2002 | Uehara et al. | |

FOREIGN PATENT DOCUMENTS

| | | |
|---|---|---|
| JP | 10-327908 | 12/1998 |
| JP | 2594412 | 2/1999 |
| JP | 2004-313268 | 11/2004 |
| WO | WO 02/21956 A2 | 3/2002 |
| WO | WO 03/005848 A1 | 1/2003 |

OTHER PUBLICATIONS

Office Action dated Oct. 24, 2008 cited corresponding Chinese Patent Application No. 200710087604.4.

* cited by examiner

*Primary Examiner*—Robert J Sandy
(74) *Attorney, Agent, or Firm*—Alston & Bird LLP

(57) ABSTRACT

A buckle includes a male member (A) and a female member (B). The male member includes a base portion (10), a pair of leg portions (20) projected from the base portion and an engagement portion (25) that is provided to each of the leg portions and engagement with the female member. The base portion includes a projected portion (14) that is projected in a projecting direction of the leg portions (20), the projected portion (14) projected in such a manner that a projecting amount gradually increases from width-direction ends of the base portion toward a center. The leg portions each include an outer leg piece (21) and an inner leg piece (22) and further includes a tip-end connector (24) that connects the outer leg piece and the inner leg piece. A base end of the inner leg piece is positioned on the projected portion (14).

4 Claims, 6 Drawing Sheets

BUCKLE

BACKGROUND OF THE INVENTION

1. Field of the Invention

The present invention relates to a buckle including a male member and a female member. More specifically, the present invention relates to a buckle that is used for connecting or disconnecting both ends of one string member or connecting or disconnecting two string members.

2. Description of Related Art

There has been used a buckle for connecting or disconnecting both ends of one string member or connecting or disconnecting two string members.

A conventional buckle includes a plug and a socket in which the plug is inserted to be engaged. The plug includes a plug body and a pair of leg portions formed in parallel to each other on both lateral sides of the plug body. An operating portion and an engaging portion are formed in a tip end of each of the leg portions. The socket includes a socket body and an insertion hole formed on the socket body for the plug to be inserted thereto. The insertion hole is provided with: abutment portions that abut on the leg portions to elastically deform the leg portions inward; to-be-engaged portions with which the engaging portions of the leg portions are engaged; and openings from which the operating portions of the leg portions are exposed.

With the arrangement, in order to engage the plug with the socket, the leg portions of the plug are inserted to the insertion hole of the socket. The tip ends of the leg portions are inserted in the socket while being elastically deformed inward by the abutment portions of the socket. When the engaging portions of the leg portions pass through the to-be-engaged portions of the socket, the leg portions having been elastically deformed inward elastically recover, so that the engaging portions of the leg portions are engaged with the to-be-engaged portions of the socket. In this state, the operating portions of the plug are exposed to the outside from the openings of the socket.

In order to disengage the plug from the socket, the operating portions of the plug that are exposed from the openings of the socket are pushed inward so that the leg portions are elastically deformed inward. Then, the engaging portions of the leg portions are disengaged from the to-be-engaged portions of the socket. From this state, the plug is pulled out from the socket. Through the operation, the plug can be disengaged from the socket.

In such a buckle, since the leg portions of the plug are arranged to be elastically deformable inward and outward, when the leg portions are deformed outward excessively (e.g., when the leg portions of the plug are held and opened outward excessively), the leg portions might be broken.

In order to solve the problem described above, there has been proposed an arrangement of a buckle in which a center member is projected in parallel to and between a pair of leg portions (arm members) of the plug, and the arm members and the center member are connected with a holding strap (see, for instance, Document: JP-A-10-327908). With the arrangement, when the arm members are opened outward, the holding strap is stretched to restrict the arm members so as not to be opened outward further, thereby preventing breakage of the arm members.

However, in the buckle disclosed in Document, the holding strap and the plug are integrally molded from a common material and the holding strap is arranged at a position where the arm members of the plug are maximally deformed, so that operations for inserting the plug into the socket and disengaging the plug from the socket become heavy.

More specifically, when the plug is inserted in the socket or when the plug is disengaged from the socket, the arm members need to be elastically deformed inward. However, in the conventional buckle, since the holding strap is arranged between tip ends of the arm members and a tip end of the center member, the holding strap causes a large resistance force when the arm members are elastically inward, which causes the operations to be heavy.

SUMMARY OF THE INVENTION

An object of the present invention is to provide a buckle having an excellent operability in engagement and disengagement while being capable of preventing breakage of leg portions when the leg portions are deformed outward.

A buckle according to an aspect of the present invention includes: a male member; and a female member in which the male member is inserted and engaged, the male member including: a base portion to which a string member can be attached; a pair of leg portions that are projected from the base portion and elastically deformable in a direction intersecting an insertion direction of the male member; and an engaging portion that is provided to each of the leg portions and engageable with the female member, the base portion including a projected portion that is projected in a projecting direction of the leg portions from a formation side of the leg portions, the projected portion projected in such a manner that a projecting amount gradually increases from width-direction ends of the base portion toward a center, each of the leg portions having an outer leg piece and an inner leg piece that are each elastically deformable in the direction intersecting the insertion direction of the male member, tip ends of the outer leg piece and the inner leg piece connected with each other, a base end of the inner leg piece being positioned on the projected portion.

According to the aspect of the present invention, the base portion of the male member is provided with the projected portion on a leg portion formation side and the leg portions of the male member each include the outer leg piece and the inner leg piece, the base end of the inner leg piece positioned on the projected portion. In other words, the base end of the inner leg piece is positioned at a position closer to a tip end side relative to a base end of the outer leg piece, so that when the leg portions are deformed outward (opened outward), the inner leg piece can prevent the leg portions from being opened excessively. Accordingly, the leg portions can be prevented from being opened excessively, thereby preventing breakage of the leg portions when the leg portions are deformed outward.

In addition, the base end of the inner leg piece is positioned on the projected portion projected from the leg formation side of the base portion. In other words, the base end of the inner leg piece is positioned at the position closer to the tip end side relative to the base end of the outer leg piece, but in the vicinity of a supporting point of elastic deformation of the outer leg piece (outward elastic deformation), so that a resistance force generated in elastically deforming the leg portions inward for engaging or disengaging the buckle becomes small as compared to a conventional arrangement. Accordingly, operability in the engagement and disengagement can be enhanced. Therefore, the engagement and disengagement of the buckle can be performed with a small force. The wording "in the vicinity of a supporting point" refers to an area closer to a base end side of the outer leg piece relative to a middle position of the length in the insertion direction of the outer leg piece, and the base end of the inner leg piece is connected to a portion corresponding to this area in the projected portion.

In the buckle according to the aspect of the present invention, it is preferable that the projected portion is formed in a triangle shape having oblique sides extending from the width-direction ends of the base portion toward the center and that the base end of the inner leg piece is positioned substantially at a middle part of the oblique side of the projected portion.

According to the aspect of the invention, the projected portion is formed in the triangular shape and the base end of the inner leg piece is positioned substantially in the middle of the oblique side of the triangle. With the arrangement, the strength of the base portion can be enhanced and the base end of the inner leg piece can be positioned at the position closer to the tip end side relative to the base end of the outer leg piece.

In the buckle according to the aspect of the present invention, it is preferable that the inner leg piece includes a bend portion that is bent further from its original state when the leg portions are deformed inward and is straightened when the leg portions are deformed outward to restrict outward deformation of a certain level or more of the outer leg piece.

According to the aspect of the present invention, when the leg portion is deformed inward, the bend portion is bent further from its original bent state, thereby further enhancing the operability of the engagement and disengagement of the buckle. In addition, when the leg portion is deformed outward, the bend portion is maximally straightened to restrict the outer leg piece from being further deformed outward, thereby preventing the leg portion from being opened excessively.

In the buckle according to the aspect of the present invention, it is preferable that that the bend portion of the inner leg piece is curved such that the bend portion extends in a direction toward the outer leg piece and then in a direction away from the outer leg piece from the base end toward a tip end of the inner leg piece.

According to the aspect of the present invention, the bend portion of the inner leg piece is curved such that the bend portion extends in the direction toward the outer leg piece and then in the direction away from the outer leg piece from the base end toward the tip end of the inner leg piece. With the arrangement, the leg portion can be easily deformed inward. Accordingly, the operability in the engagement and disengagement of the buckle can be enhanced.

In the buckle according to the aspect of the present invention, it is preferable that a thickness in an inward/outward elastic deformation direction of the inner leg piece is smaller than that of the outer leg piece.

According to the aspect of the present invention, the leg portion can be easily deformed inward as in the arrangement described above, the operability in the engagement and disengagement of the buckle can be enhanced.

DETAILED DESCRIPTION OF PREFERRED EMBODIMENT(S)

An embodiment of the present invention will be described with reference to the attached drawings.

Figure 1:
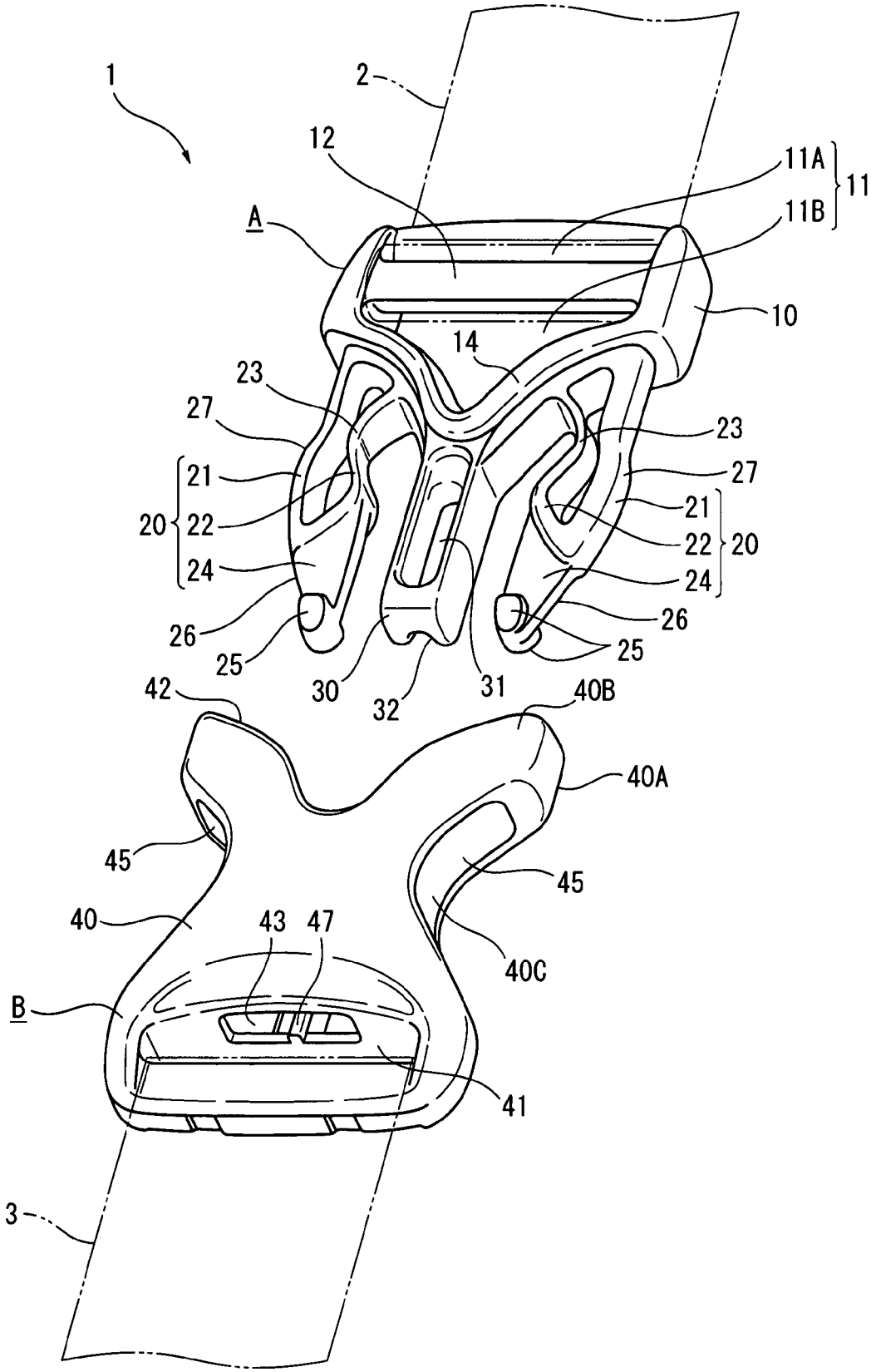
FIG. 1 is an exploded perspective view showing a buckle according to an embodiment of the present invention.
Figure 2:
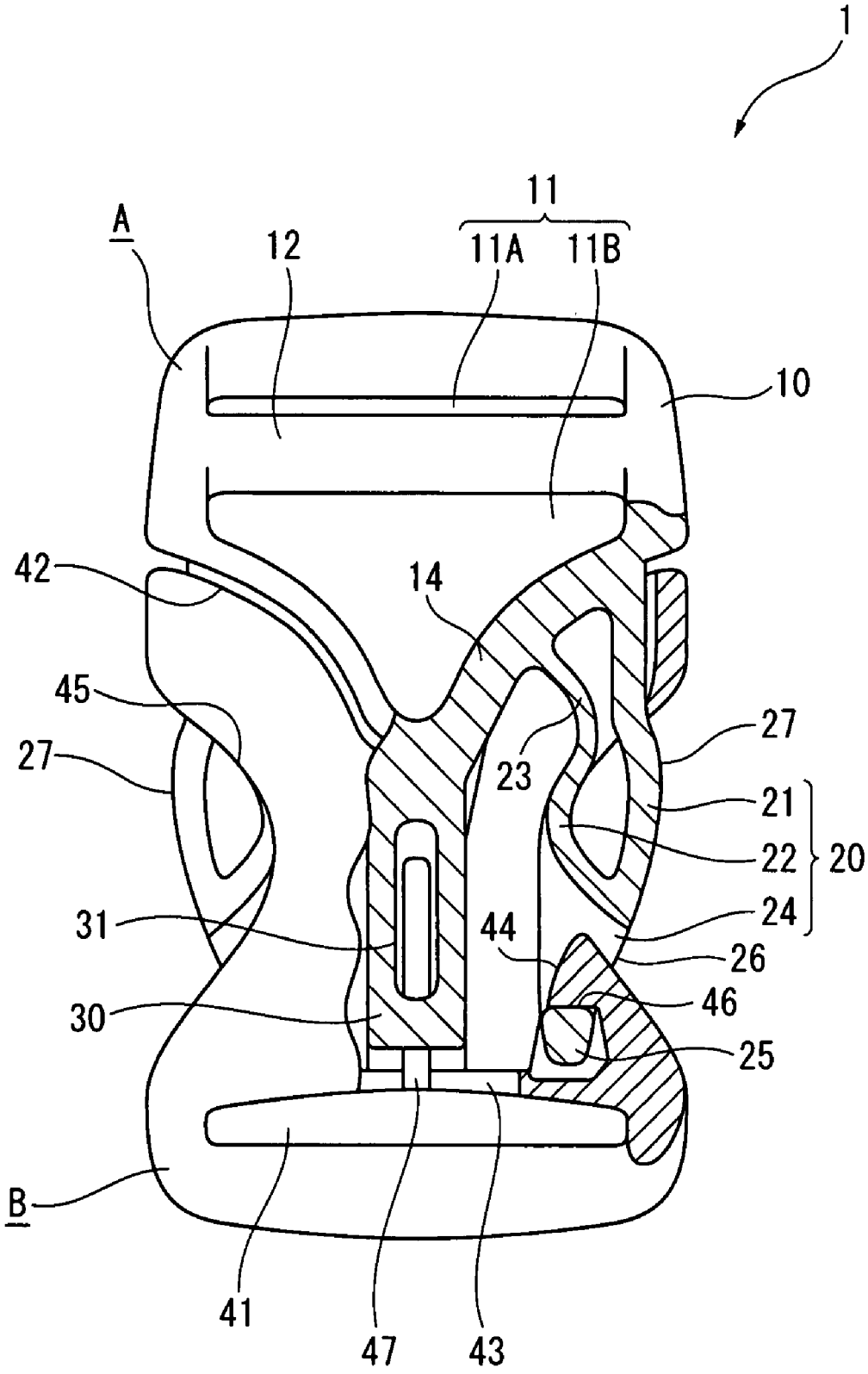
FIG. 2 is a partial cross section showing engagement of the buckle according to the embodiment.

FIG. 1 is an exploded perspective view of a buckle of the present embodiment, while FIG. 2 is a partial cross section showing engagement of the buckle.

A buckle 1 of the present embodiment is used for connecting or disconnecting ends 2, 3 of a string member, the buckle 1 including a male member A integrally formed from synthetic resin and a female member B also integrally formed from synthetic resin, the male member A being inserted in and engaged with the female member B. Materials of the male member A and female member B are not limited to the synthetic resin, but may be other materials such as metal.

The male member A includes a base portion 10; a pair of leg portions 20 projected in parallel to each other from both lateral sides in a width direction (a direction orthogonal to an insertion direction of the male member A) of the base portion 10, the leg portions being elastically deformable in a direction intersecting (specifically, in a direction substantially orthogonal to) the insertion direction of the male member A; and a guide piece 30 provided between and in parallel to the leg portions 20.

The base portion 10 is provided with a string attachment hole 11 (string attachment portion) in which the end 2 of the string member is inserted and held at an inner central part and further provided with a projected portion 14 on a formation side of the leg portions on a frame where the leg portions 20 are project.

A connecting bar 12 is provided at a middle part of the string attachment hole 11, the connecting bar 12 zoning the string attachment hole 11 into two string attachment holes 11A, 11B. With the arrangement, the length of the string member can be adjusted.

The projected portion 14 projects in a projection direction of the leg portion 20 from the formation side of the leg portion 20 on the base portion 10, the projection portion 14 projecting in such a manner that a projecting amount of the projected portion 14 becomes greater from both width-direction ends toward the center of the base portion 10. In other words, the projected portion 14 is formed in an isosceles triangle having oblique sides extending from the width-direction ends toward the center of the base portion 10.

Figure 3:
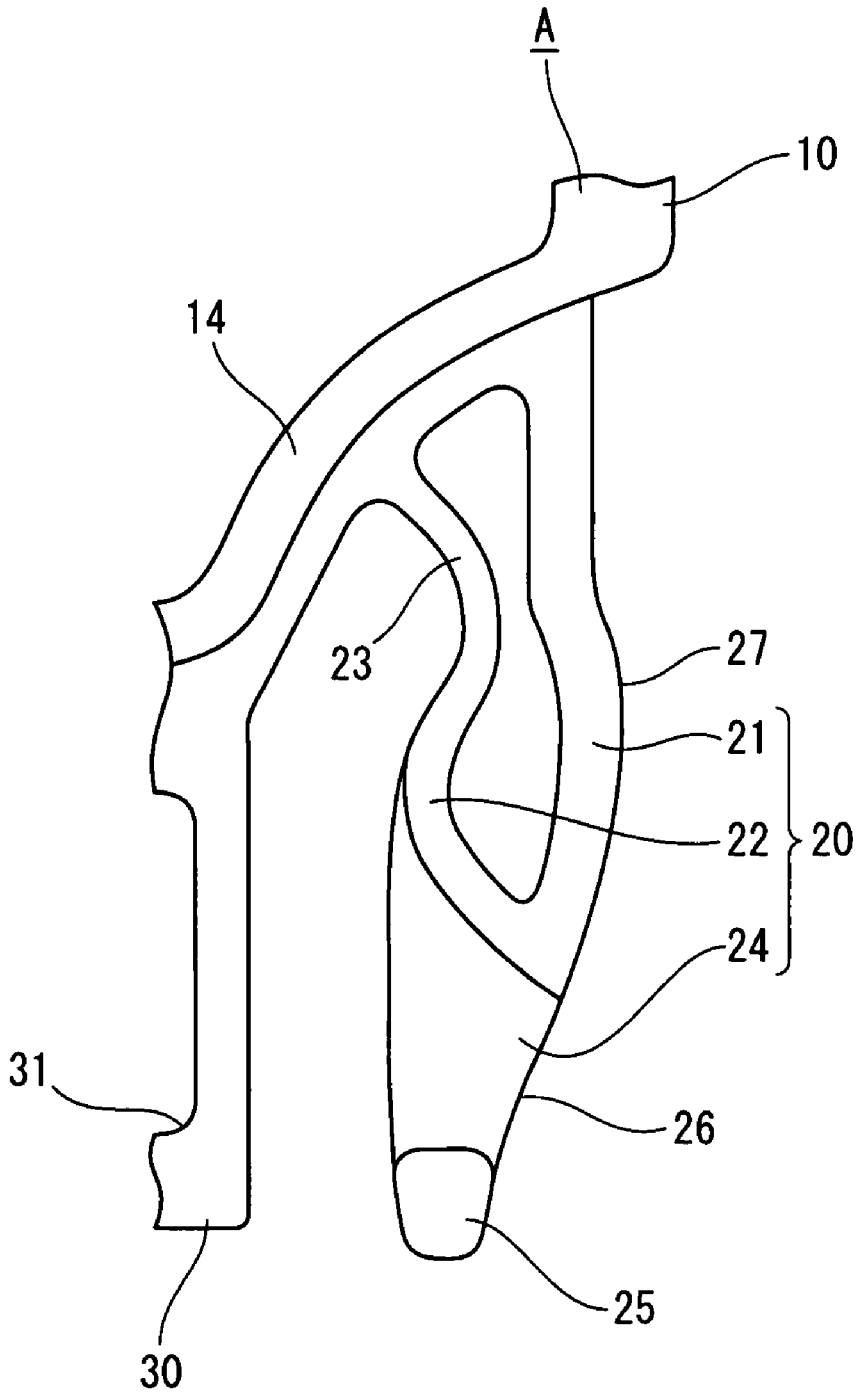
FIG. 3 is an enlarged view showing a portion around a leg portion according to the embodiment.

As shown in detail in FIG. 3, the leg portions 20 each include an outer leg piece 21 and an inner leg piece 22 each being elastically deformable in a direction substantially orthogonal to the insertion direction of the male member A and a tip-end connector 24 that connects tip ends of the outer leg piece 21 and the inner leg piece 22. The inner leg piece 22 is provided closer to the center relative to the outer leg piece 21.

The outer leg piece 21 linearly extends in the insertion direction of the male member A from both lateral sides of the base portion 10 in such a manner that the outer leg piece 21 is slightly bulged outward at a middle position toward a tip end and then curved inward to form a gentle arc.

A base end of the inner leg piece 22 is positioned substantially at the middle of the oblique side of the projected portion 14, namely the base end of the inner leg piece 22 is positioned at a position loser to the tip end side of the leg portion 20 relative to a base end of the outer leg piece 21, the inner leg piece 22 having a bend portion 23 between its base end and tip end. The bend portion 23 is further bent when the leg portion 20 is deformed inward, while being straightened when the leg portion 20 is deformed outward to restrict outward deformation of a certain level or more of the outer leg piece 21. Specifically, the bend portion 23 is formed in a shape in which the bend portion 23 is, from the base end toward the tip end, extended in a direction perpendicular to the oblique side of the projected portion 14 toward the outer leg piece 21 and, once coming close to the outer leg piece 21, curved in a direction apart from the outer leg piece 21, and again curved in a direction toward the outer leg piece 21. Note that the bend portion 23 may be formed such that the bend portion 23 is bent to be extended in a direction substantially perpendicular to the oblique side of the projected portion 14 toward the outer leg piece 21, extended in parallel to the outer leg piece 21 and connected with the outer leg piece 21 by a tip-end connector 24, in addition to the above-described shape. In other words, the bend portion 23 is positioned on a side closer to the base portion 10 relative to the tip-end connector 24.

The thickness in an inward/outward deformation direction of the inner leg piece 22 is thinner than that of the outer leg piece 21.

The tip-end connector 24 has a shape in which the width is gradually narrowed from a tip-end connecting portion connecting the outer leg piece 21 and the inner leg piece 22 toward a tip end, the tip end of the tip-end connector 24 provided with engaging portions 25 projecting from front and back surfaces of the tip-end connector 24. An insertion guide surface 26 and an operating portion 27 are formed at a position between an outer contour edge of the tip-end connector 24 and a middle part of an outer contour edge of the outer leg piece 21.

The guide piece 30 projects in parallel to the pair of leg portions 20 from the tip end of the projected portion 14, the guide piece 30 provided with an oblong hole 31 at the center thereof and a guide groove 32 on a back surface thereof, the oblong hole 31 and the guide groove 32 formed along a longitudinal direction of the guide piece 30.

The female member B includes a female member body 40 having a flattened cylinder shape.

The female member body 40 includes: a string attachment hole 41 (string attachment portion) in which the end 3 of the string member is inserted and held; and an insertion hole 43 penetrating from a joint surface 42 to be jointed with the male member A to the string attachment hole 41, in which the leg portions 20 and the guide piece 30 of the male member A are inserted. The joint surface 42 of the female member B (the joint surface to be jointed with the male member A) is formed in an arcuate shape with the middle part thereof dented inward in order to allow the projected portion 14 of the male member A to be inserted fitted therein.

Formed on both lateral walls on a rear side of the insertion hole 43 are openings 45 for exposing the operating portions 27 of the male member A to the outside. The opening 45 is formed by cutting out a lateral wall 40A, front and back walls 40B, 40C out of walls around the insertion hole 43 of the female member body 40, the cutout provided in a concave shape that is dented inward.

Formed on a rear side the insertion hole 43 relative to the opening 45 are abutment portions 44 abutting on the insertion guide surfaces 26 of the leg portions 20 to elastically deform the leg portions 20 in a direction substantially orthogonal to the insertion direction (inward), and formed on a rear side of the abutment portions 44 are to-be-engaged portions 46 with which the engaging portions 25 of the leg portions 20 are engaged to bring the male member A into engagement with the female member B.

A projected tread 47 that is fit in the guide groove 32 of the guide piece 30 is formed along the insertion direction of the male member A on an inner surface of the back wall 40C.

With the arrangement, in order to engage the male member A with the female member B, the leg portions 20 of the male member A are inserted in the insertion hole 43 of the female member B. Due to the operation, the insertion guide surfaces 26 formed on the tip ends of the leg portions 20 abut on the abutment portions 44 of the female member B, so that the leg portions 20 are inserted while being elastically deformed in the direction substantially orthogonal to the insertion direction (inward).

Figure 4:
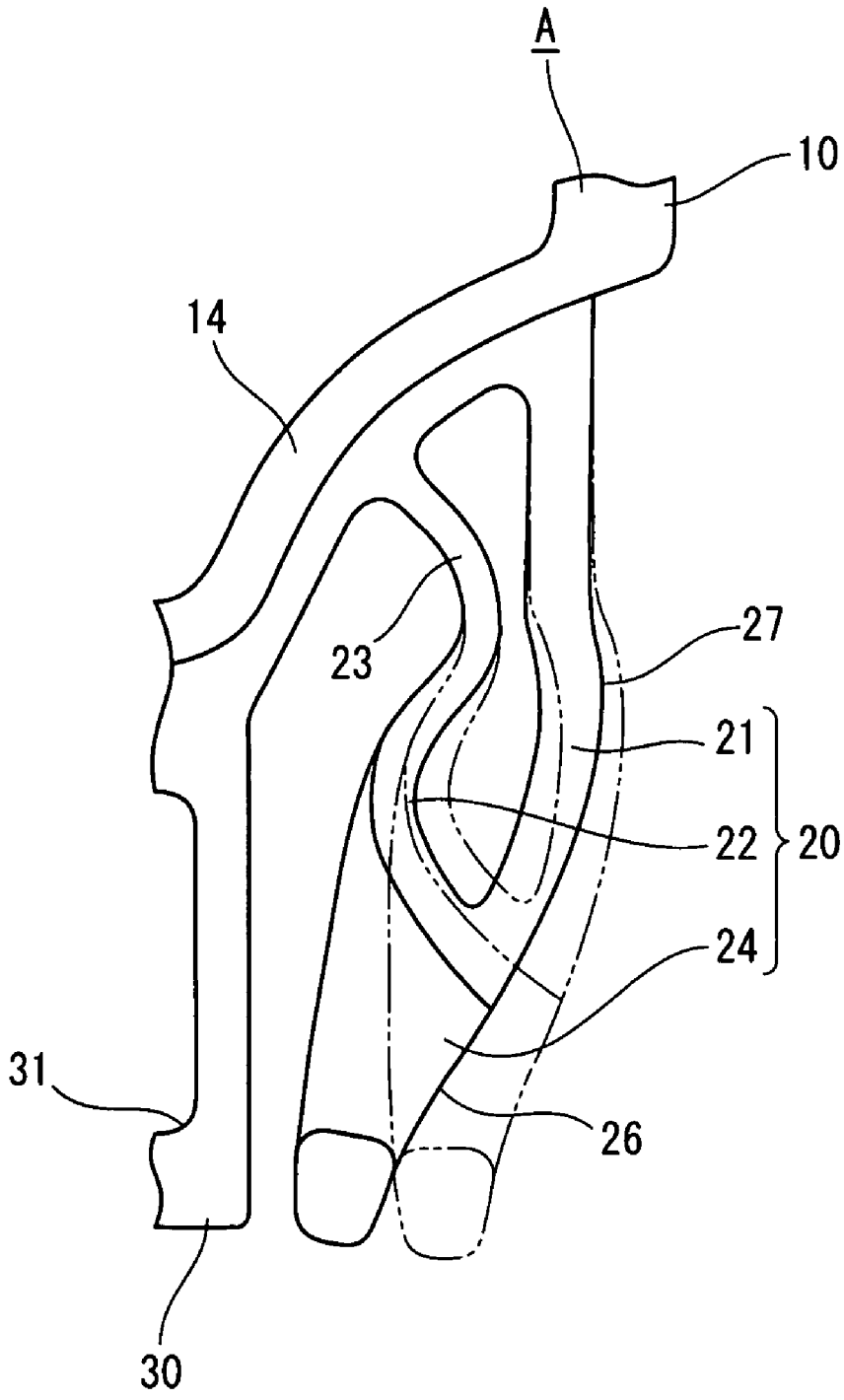
FIG. 4 is an illustration showing a state in which the leg portion is deformed inward according to the embodiment.

At this time, the leg portion 20 is elastically deformed inward as shown in FIG. 4. Specifically, the outer leg piece 21 is elastically deformed inward with its base end being a supporting point, while the inner leg piece 22 is elastically deformed inward with the bend portion 23 being further bent. Since the inner leg piece 22 is thinner than the outer leg piece 21 and has the bend portion 23 at the middle part thereof, the inner leg piece 22 is easily deformable inward, so that the leg portion 20 can be deformed without necessity of a large force. In short, the above operation can be performed with a small force.

When the male member A is inserted until the engaging portion 25 of the leg portion 20 reaches a position beyond the to-be-engaged portion 46, the leg portion 20 having elastically deformed inward elastically recover to an original state (returns outward), which brings the engaging portion 25 of the leg portion 20 into engagement with the to-be-engaged portion 46 of the female member B. Consequently, the male member A can be engaged with the female member B.

In order to disengage the male member A from the female member B, the operating portion 27 of the leg portion 20 that projects from the opening 45 of the female member B is pushed inward. With the operation, the leg portion 20 of the male member A is elastically deformed inward. At this time too, the leg portion 20 is elastically deformed inward by the principle shown in FIG. 4, so that the operation can be performed with a small force.

Consequently, the engaging portion 25 is disengaged from the to-be-disengaged portion 46. In this state, by pulling out the male member A from the female member B, the male member A can be disengaged from the female member B.

In a state where the male member A is disengaged from the female member B, when a force acts on the leg portion 20 of the male member A in an opening direction, the leg portion 20 is elastically deformed outward.

Figure 5:
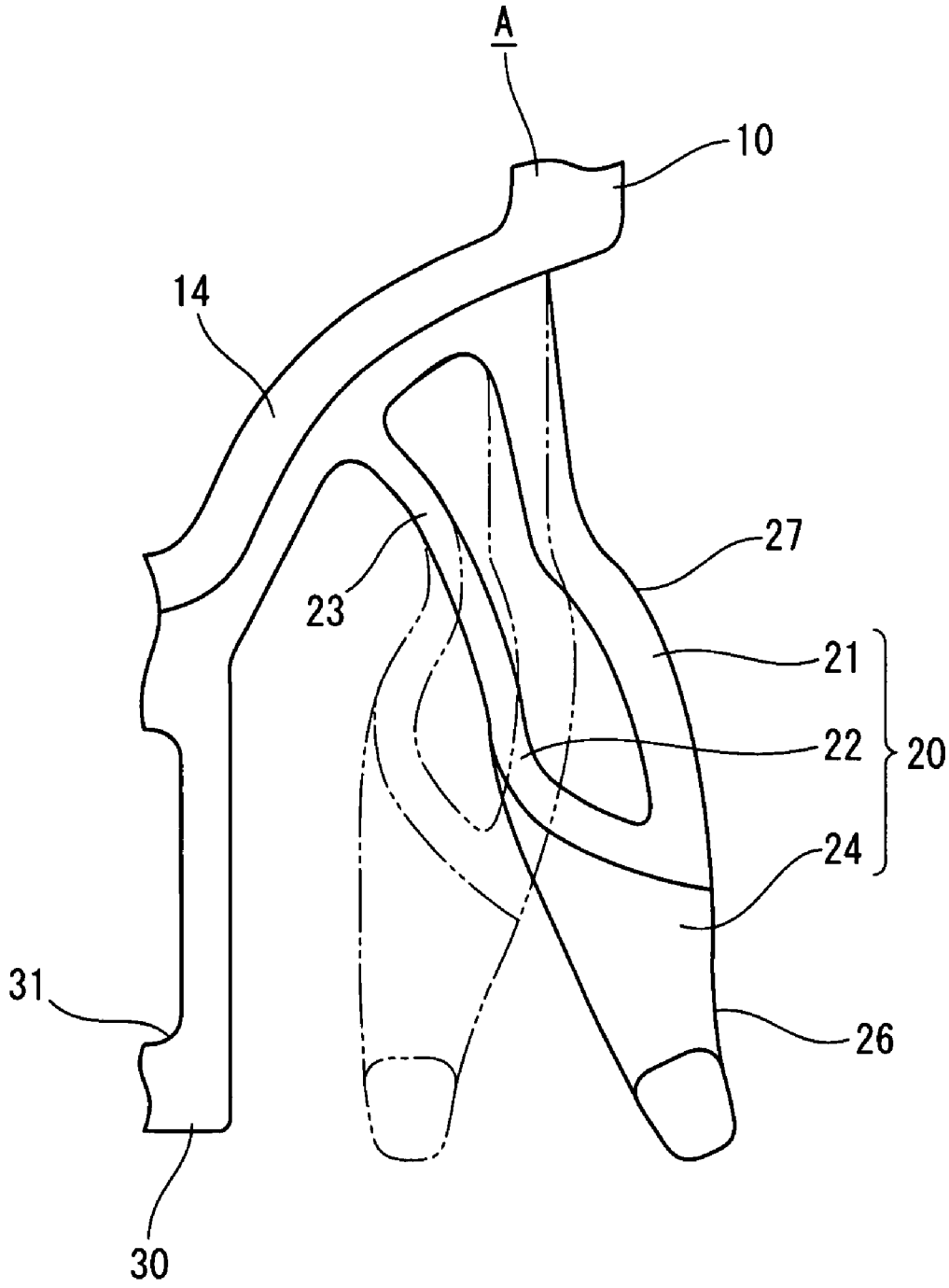
FIG. 5 is an illustration showing a state in which the leg portion is deformed outward according to the embodiment.

At this time, since the projected portion 14 is formed on the base portion 10 of the male member A and the base end of the inner leg piece 22 of the leg portion 20 is formed at the middle of the oblique side of the projected portion 14 as shown in FIG. 5, the inner leg piece 22 can prevent the leg portion 20 from being opened excessively when the leg potion 20 is elastically deformed outward. Specifically, when the leg portion 20 is elastically deformed outward, the outer leg piece 21 is elastically deformed outward with its base end being the supporting point, but the bend portion 23 of the inner leg piece 22 is gradually straightened, and when the bend portion 23 is straightened maximally, the bend portion 23 can restrict the outward deformation of the outer leg piece 21, thereby preventing the leg portion 20 from being opened excessively. Accordingly, breakage of the leg portion 20 can be prevented when the leg portion 20 is deformed outward.

In addition, in this state, the bend portion 23 of the inner leg piece 22 is straightened to be substantially orthogonal to the oblique side of the projected portion 14, bending stress does not act on connecting portions between the bend portion 23 and the oblique side of the projected portion 14 and between the bend portion 23 and the inner leg piece 22, the connecting portions will not be broken.

It should be noted that the present invention is not limited to the buckle having the arrangement described in the above embodiment, but includes modification examples below.

Figure 6:
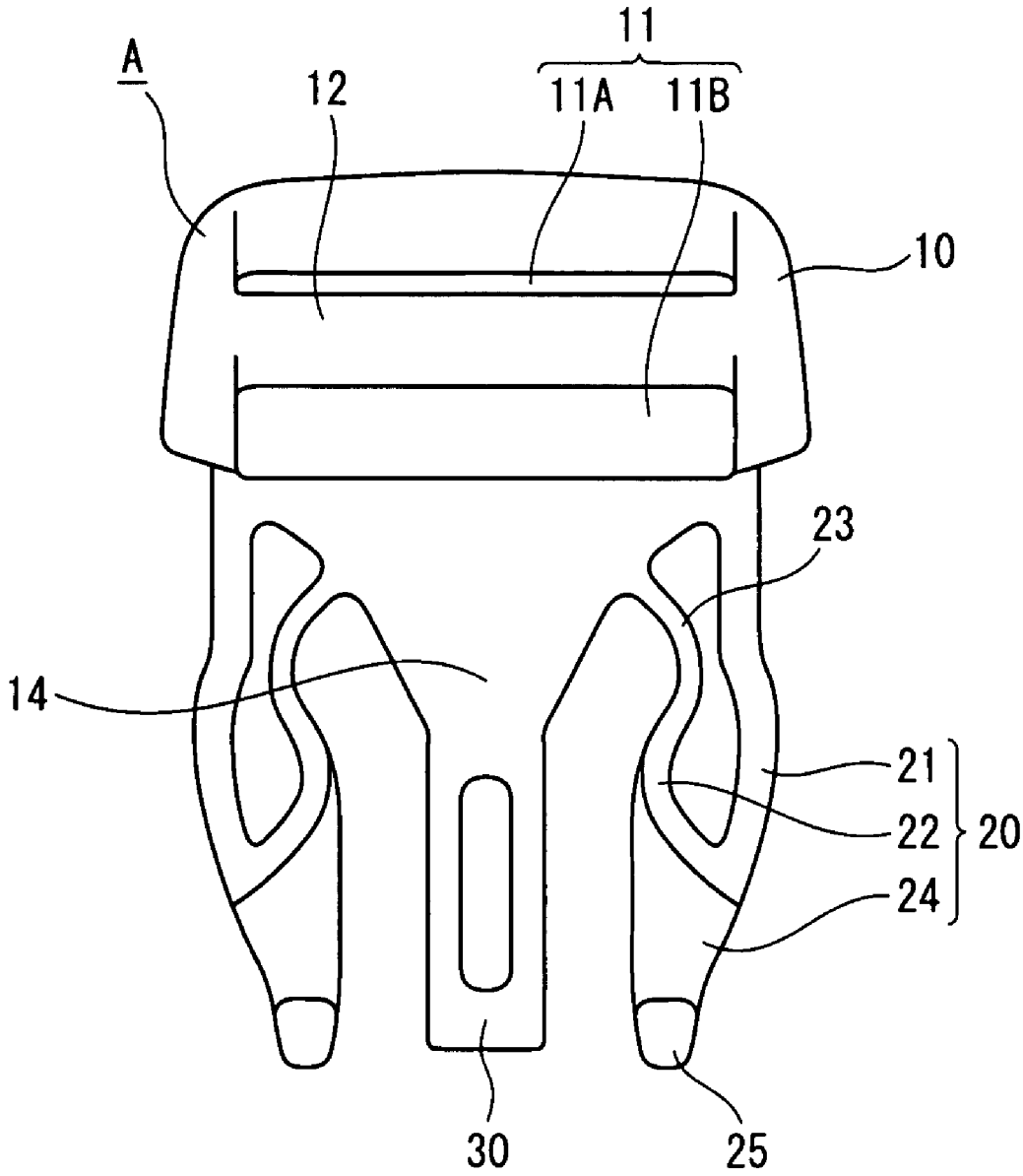
FIG. 6 is a plan view showing a male member of a buckle according to another embodiment of the present invention.

Although the frame of the base portion 10 on the formation side of the leg portion 20 is molded in the isosceles triangle shape to form the projected portions 14 in the embodiment above, the projected portion 14 having the isosceles triangle shape may be integrally formed with the frame as shown in FIG. 6. In short, the projected portion 14 may be formed to have a solid triangle shape.

With the arrangement, even when the leg portion 20 is deformed outward and the inner leg piece 22 is straightened maximally to cause a tensile force to act on the projected portion 14, the projected portion 14 can be prevented from being bent in a direction of the tensile force or being broken. Note that the oblique side of the projected portion 14 is not limited to a linear one but includes a curved one as long as the oblique side is inclined toward the center relative to the insertion direction of the male member A.

Although the base end of the inner leg piece 22 of the leg portion 20 is positioned substantially at the middle of the oblique side of the projected portion 14, the base end of the inner leg piece 22 may be positioned at any position on the oblique side of the projected portion 14. However, the function for restricting the outward deformation of the leg portion 20 becomes larger as the base end of the inner leg piece 22 is positioned closer to the top of the oblique side, while the function for restricting the outward deformation of the leg portion 20 becomes smaller as the base end of the inner leg piece 22 is positioned closer to a base of the oblique side (i.e., closer to both ends of the base portion 10), so that the base end of the inner leg piece 22 is preferably set at a suitable position determined by taking into account the strength of a material and the like.

Although the engaging portion 25 of the male member A is engaged with the to-be-engaged portion (a plane substantially orthogonal to the insertion direction of the male member A) that is provided on the rear side of the insertion hole 43 of the female member B, the arrangement is not limited thereto. For example, it may be so arranged that engaging portions are provided on outer sides of the leg portions 20 of the male member A such that the engaging portions engage with the openings 45 of the female member B to bring the male member A into engagement with the female member B.

Although the male member A and the female member B are respectively provided with the string attachment holes 11, 41 as the string attachment portions in the embodiment above, the female member B may not be provided with the string attachment hole 41. That is, the female member body 40 of the female member B may be directly fixed to another member.

In addition, the string member may be a thin string having a small width without limiting to a belt-like string.

Although the male member A and the female member B are molded (by injection molding or injection compression molding) from synthetic resin, the materials are not limited thereto but may be metal or the like.

The priority application Number JP2006-056607 upon which this patent application is based are hereby incorporated by reference.

What is claimed is:

1. A buckle, comprising:

a male member; and a female member in which the male member is inserted and engaged, wherein the male member includes: a base portion to which a string member can be attached; a pair of leg portions that are projected from the base portion and elastically deformable in a direction intersecting an insertion direction of the male member; and an engaging portion that is provided to each of the leg portions and engageable with the female member, the base portion includes a projected portion that is projected in a projecting direction of the leg portions from a formation side of the leg portions, the projected portion projected in such a manner that a projecting amount gradually increases from width-direction ends of the base portion toward a center, wherein the projected portion is formed in a triangle shape having oblique sides extending from the width-direction ends of the base portion toward the center, each of the leg portions has an outer leg piece and an inner leg piece that are each elastically deformable in the direction intersecting the insertion direction of the male member, tip ends of the outer leg piece and the inner leg piece connected with each other, and a base end of the inner leg piece is positioned substantially at a middle part of the oblique side of the projected portion.

2. The buckle according to claim 1, wherein the inner leg piece includes a bend portion that is bent further from its original state when the leg portions are deformed inward and is straightened when the leg portions are deformed outward to restrict outward deformation of a certain level or more of the outer leg piece.

3. The buckle according to claim 1, wherein the inner leg piece has a bend portion, and the bend portion is curved such that the bend portion extends in a direction toward the outer leg piece and then in a direction away from the outer leg piece from the base end toward a tip end of the inner leg piece.

4. The buckle according to claim 1, wherein a thickness in an inward/outward elastic deformation direction of the inner leg piece is smaller than that of the outer leg piece.

* * * * *